US006951180B2

(12) United States Patent
Robinson et al.

(10) Patent No.: US 6,951,180 B2
(45) Date of Patent: Oct. 4, 2005

(54) CBTF SAILING YACHT MAIN ENGINE DRIVE SYSTEM

(75) Inventors: Charles W. Robinson, Santa Fe, NM (US); William F. Burns, III, San Diego, CA (US)

(73) Assignee: CBTF Co., San Diego, CA (US)

( * ) Notice: Subject to any disclaimer, the term of this patent is extended or adjusted under 35 U.S.C. 154(b) by 40 days.

(21) Appl. No.: 10/793,151

(22) Filed: Mar. 4, 2004

(65) Prior Publication Data

US 2005/0145152 A1 Jul. 7, 2005

Related U.S. Application Data

(63) Continuation-in-part of application No. 10/646,326, filed on Aug. 22, 2003, now abandoned.

(60) Provisional application No. 60/440,453, filed on Jan. 15, 2003.

(51) Int. Cl.[7] ..... B63B 43/08

(52) U.S. Cl. ..... 114/124; 114/143; 114/149; 114/163

(58) Field of Search ..... 114/121, 124, 132, 114/135, 136, 137, 143, 141, 149, 163

(56) References Cited

U.S. PATENT DOCUMENTS

| | | | | |
|---|---|---|---|---|
| 3,411,751 | A * | 11/1968 | Pooley, Jr. | 254/342 |
| 3,903,827 | A * | 9/1975 | Marcil | 114/143 |
| 4,378,748 | A * | 4/1983 | Kurtz | 114/141 |
| 5,163,377 | A * | 11/1992 | Calderon et al. | 114/39.25 |
| 5,671,691 | A * | 9/1997 | Birger | 114/162 |
| 5,839,529 | A * | 11/1998 | DePaoli | 180/65.1 |

FOREIGN PATENT DOCUMENTS

GB 2 232 126 A * 12/1990

* cited by examiner

*Primary Examiner*—Sherman Basinger
(74) *Attorney, Agent, or Firm*—Loyal McKinley Hanson

(57) ABSTRACT

A canting ballast twin foil (CBTF) sailing yacht constructed according to the invention includes a sailing hull, a ballast, a ballast-supporting structure, and an onboard ballast drive system. The ballast drive system moves the ballast in order to vary the counter-heeling force it produces underway. Twin foils that depend downwardly from the hull in positions fore and aft of the ballast provide leeway and steering control. An onboard main engine drive system provides power, either directly by suitable mechanical coupling or indirectly through charging of the battery/electric system, for one or more of a canting system, a leeway, and/or steering control system. The onboard main engine drive system may also power a yacht-propelling propeller.

12 Claims, 8 Drawing Sheets

CBTF SAILING YACHT MAIN ENGINE DRIVE SYSTEM

CROSS REFERENCE TO RELATED APPLICATION

This application is a continuation in part of U.S. patent application Ser. No. 10/646,326 filed Aug. 22, 2003 (the parent application which is now abandoned), which parent application claims the benefit of U.S. Provisional Application Ser. No. 60/440,453 filed Jan. 15, 2003.

BACKGROUND OF THE INVENTION

1. Technical Field

This invention relates generally to sailing yachts, and more particularly to a high performance canting ballast twin foil (CBTF) sailing yacht having a laterally movable ballast suspended beneath the hull that provides a counter heeling force when the yacht is underway.

2. Description of Related Art

U.S. Pat. Nos. 5,163,377 and 5,622,130 describe various aspects of a keel-less sailing yacht that has fore and aft cambered foils for leeway control and a dynamic gravitational ballast for heeling resistance. Twin foils mounted to depend from the hull are controlled by a hydraulic or electric system. A ballast-supporting structure in the form of an elongated strut extending downwardly from the hull supports the ballast generally beneath the hull. The proximal or near end of the strut is mounted on the hull pivotally and the distal or far end is connected to the ballast. Suitable means are provided (e.g., hydraulic drive components) for swinging the strut between port and starboard limits of travel. That arrangement enables a crew member to move the ballast to desired positions intermediate the port and starboard limits of travel while underway for a desired counter-heeling effect.

A keel-less sailing yacht with movable ballast is sometimes referred to as a canting ballast twin foil (CBTF) sailing yacht. Such CBTF sailing yachts enjoy recognized sailing success accompanied by significant interest in CBTF technology. However, various structural and operational concerns need attention. Larger sailing yachts, for example, including those designed for ocean racing or cruising, require greater force to move the ballast-supporting structure. Although hydraulic means have been suggested for prior art canting ballast systems, larger sailing yachts impose structural and operational limitations on a hydraulic cylinder and related hydraulic drive components used to move the ballast-supporting structure. The probability of catastrophic hydraulic component failure increases, and so a need exists for a better way to move the ballast on larger sailing yachts.

U.S. patent application Ser. No. 10/646,326 filed Aug. 22, 2003 (the parent application of which this application is a continuation in part, which parent application is now abandoned) addresses the above-described need by providing an onboard ballast drive system for moving the ballast under operator control. The system includes dual hydraulic cylinders connected to different portions of the hulls. Multiple hydraulic pumps may be included along with crossover hydraulic pressure lines to allow any pump to serve any one or two or more hydraulic cylinders. A redundant system with better force distribution results that significantly reduces the risk of failure of any part of the system when engaged in ocean racing or cruising. Although the onboard ballast drive system is effective, it is desirable to expand upon the means of powering it.

SUMMARY OF THE INVENTION

It is an objective of this continuation-in-part application to continue the description and claims presented in the parent application for overcoming the foregoing and other disadvantages of prior art canting ballast and twin foil systems, and to expand upon the invention by adding further information and claims about the means of powering the twin foil control system and controlling the twin foils for improved leeway and steering control. Accordingly, the invention provides an onboard ballast drive system for moving the ballast under operator control that includes not only the dual hydraulic cylinders connected to different portions of the hulls as described in the parent application, but also a main engine drive system together with twin foil leeway and steering controls powered hydraulically by the main engine drive directly or indirectly through recharging of the battery/electric system.

Multiple hydraulic pumps may be included as discussed in the parent application, along with crossover hydraulic pressure lines to allow any pump to serve any one or two or more hydraulic cylinders. A redundant system with better force distribution significantly reduces the risk of failure of any part of the system when engaged in ocean racing or cruising. In addition, the means for powering the control system provides increased power for operation of two foils for leeway control or, alternatively, for more efficient vessel turning for larger ocean yachts.

To paraphrase some of the more precise language appearing in the claims and introduce the nomenclature used, a sailing yacht constructed according to the invention includes a sailing hull, a ballast, a ballast-supporting structure, and an onboard ballast drive system. The ballast-supporting structure functions as means for supporting the ballast beneath the sailing hull moveably in order to produce a counter-heeling force that can be varied underway by moving the ballast-supporting structure. The ballast drive system functions as means for moving the ballast-supporting structure under operator control.

According to a first major aspect of the invention, the ballast drive system includes at least two hydraulic cylinders. A first one of the two hydraulic cylinders is mechanically connected between the ballast-supporting structure and a first portion of the hull, while a second one of the two hydraulic cylinders is mechanically connected between the ballast-supporting structure and a second portion of the hull. Preferably two or more hydraulic pumps and crossover valving is included.

According to a second major aspect of the invention, the sailing yacht includes an onboard main engine ballast drive system that functions both as means for propelling the sailing hull and as means for powering the ballast drive system. The main engine drive system includes a main engine onboard the sailing hull, a hydraulic pump driven directly or indirectly by the main engine that pumps hydraulic fluid, a directional valve that couples the hydraulic fluid under operator control to a hydraulic motor that drives a yacht-propelling propeller and a flow control valve that couples the hydraulic fluid to the ballast drive system. Hydraulic, twin-foil, leeway and steering control systems are also provided in various combinations, powered directly or indirectly by the main engine.

Thus, the invention provides a sailing yacht with structural improvements that overcome some significant disadvantages of prior art canting ballast systems while providing functionality that enhances sailing yacht operation. The main engine drives the propeller and the hydraulic system.

Twin foils provide the advantage of both leeway and steering control. The following illustrative drawings and detailed description make the foregoing and other objects, features, and advantages of the invention more apparent.

DESCRIPTION OF THE PREFERRED EMBODIMENTS

The description of the preferred embodiments begins with a restatement of the information presented in U.S. patent application Ser. No. 10/646,326 filed Aug. 22, 2003 (the parent application which is now abandoned). Thereafter, additional information is presented on the main engine drive system for the ballast drive and for the fore and aft foils. A reader already familiar with the specification and FIGS. 1–5 of the parent application, may proceed directly to the additional information.

Figure 1:
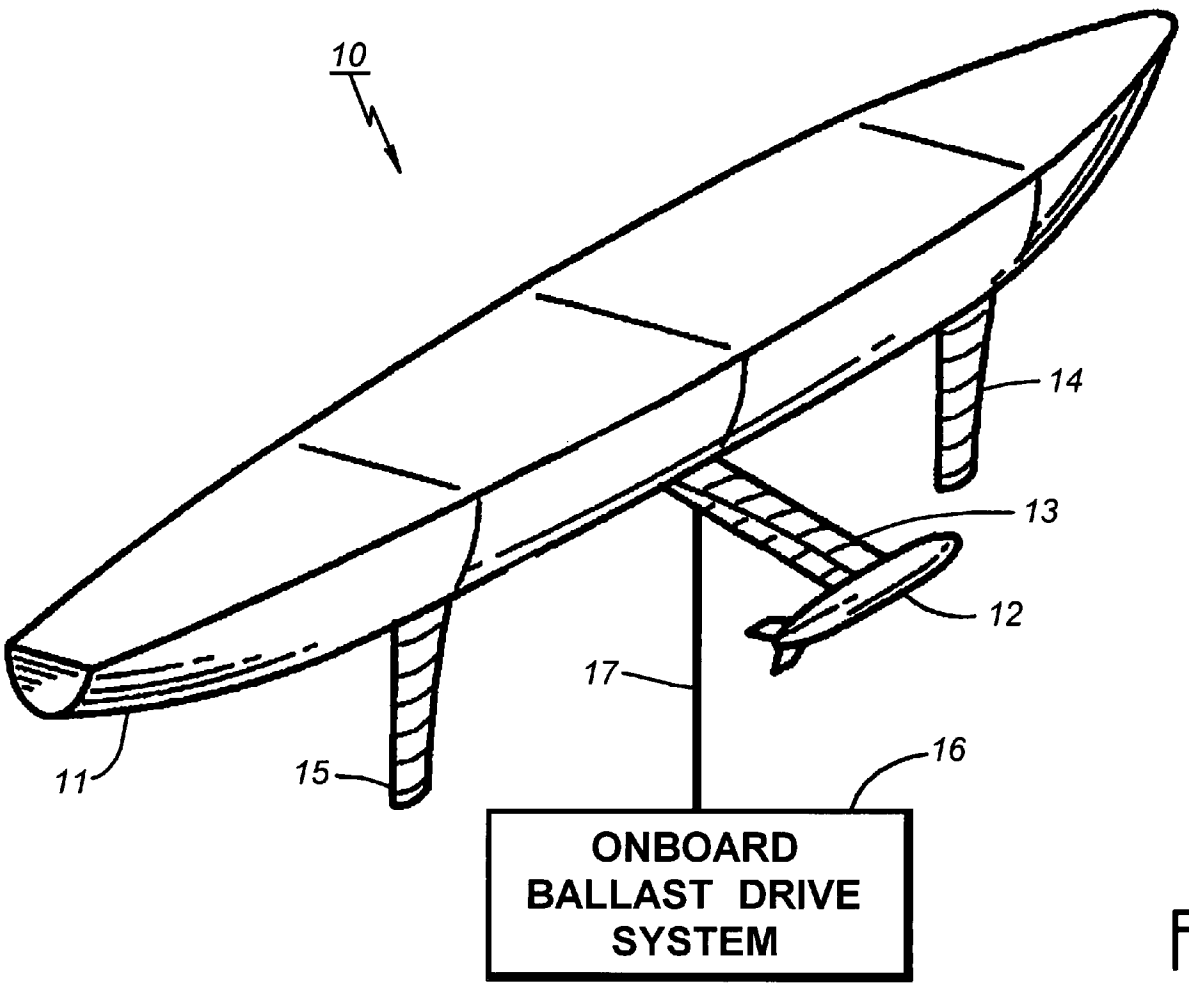
FIG. 1 of the drawings is a diagrammatic representation of a canting ballast twin foil (CBTF) sailing yacht with an onboard ballast drive system constructed according to the invention.
Figure 2:
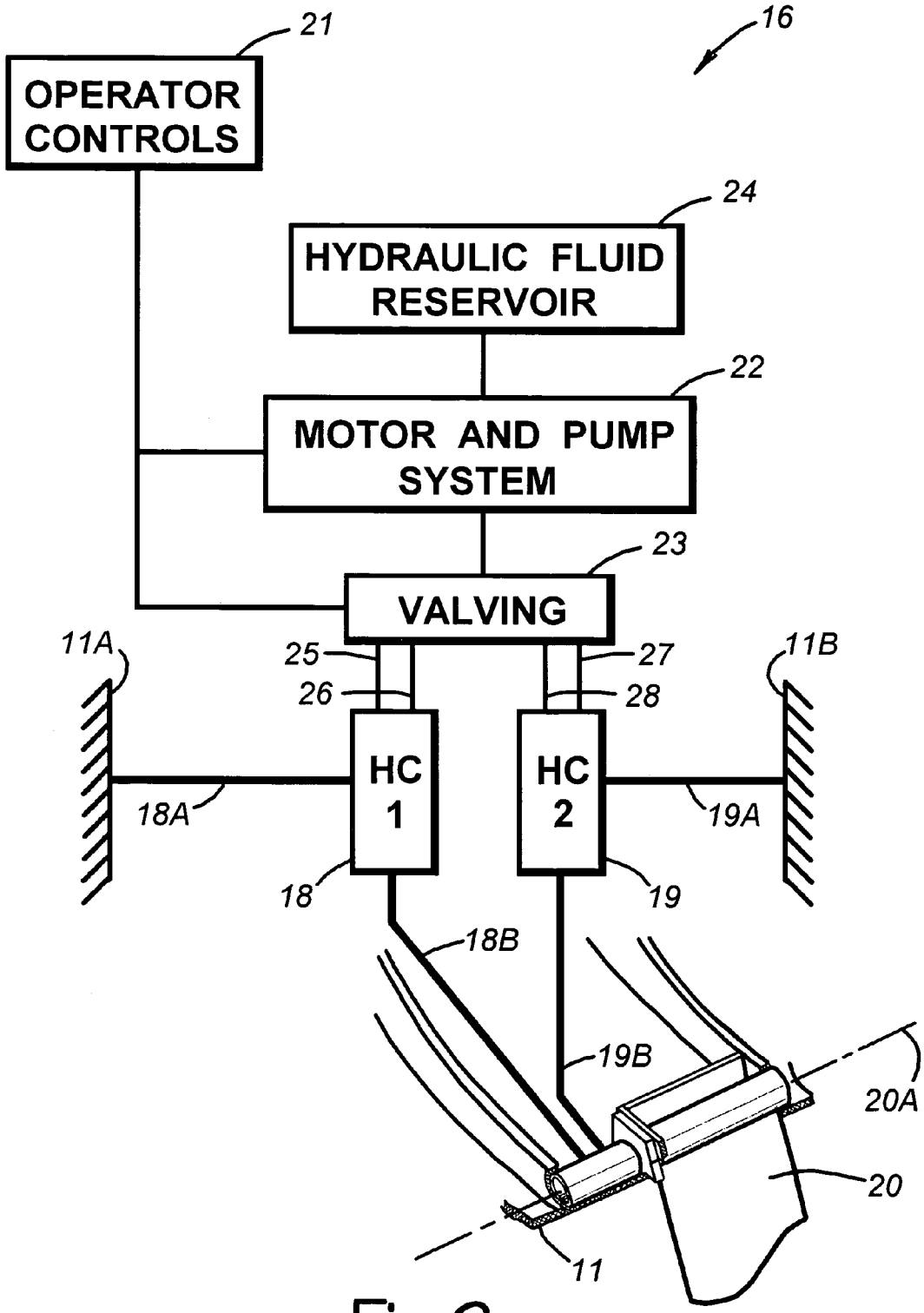
FIG. 2 is a perspective view of a strut portion of the ballast-supporting structure together with a block diagram of the ballast drive system.

Ballast Drive System. FIGS. 1–5 of the drawings show various aspects of a sailing yacht 10 constructed according to the invention. Generally, the sailing yacht 10 includes a sailing hull 11, a ballast 12, a moveable ballast-supporting structure 13, and fore and aft foils 14 and 15 (FIGS. 1 and 2). Those components operate in some respects according to known canting ballast twin foil (CBFT) operation, and additional known components of the sailing yacht 10 are not shown for illustrative convenience. Reference may be made to U.S. Pat. Nos. 5,163,377 and 5,622,130 for further details of a keel-less CBFT sailing yacht that has fore and aft cambered foils for leeway control and a dynamic gravitational ballast for heeling resistance.

For purposes of describing the present invention, the ballast-supporting structure 13 is said to function as means for supporting the ballast 12 beneath the sailing hull 11 moveably in order to produce a counter-heeling force that can be varied underway by moving the ballast-supporting structure 13. The sailing yacht 10 also includes a ballast drive system 16 onboard the sailing hull 11 for that purpose as depicted in block diagram form in FIGS. 1 and 2. The ballast drive system 16 is mechanically connected to the ballast-supporting structure 13, as depicted by a bold line 17 in FIG. 1, and it functions as means for moving the ballast-supporting structure 13 in order to move the ballast 12 and thereby vary the counter-heeling force. An operator can control ballast position with the ballast drive system 16 while underway for maximum righting moment, safety, and shock mitigation.

Any of various drive mechanisms may be used to perform that function, including a hydraulic form of ballast drive system. The drive system 16 is such a hydraulic drive system as depicted in block diagram form in FIG. 2. According to a major aspect of the invention, the hydraulic ballast drive system 17 includes at least two hydraulic cylinders. They are identified in FIG. 2 as a first hydraulic cylinder 18 and a second hydraulic cylinder 19. They may take the form of known components and they are installed as multiple hydraulic cylinders connected to the hull 11 and a strut portion 20 of the ballast-supporting structure 13 in order to provide greater force and redundancy that helps avoid catastrophic failure underway.

Preferably, the first and second hydraulic cylinders 18 and 19 are connected to different portions of the hull 11 for better force distribution. Thus, the first hydraulic cylinder 18 is mechanically connected to a first portion 11A of the hull 11, as depicted in FIG. 2 by a bold line 18A, and to the strut portion 20, as depicted by a bold line 18B. Similarly, the second hydraulic cylinder 19 is mechanically connected to a second portion 11B of the hull 11, as depicted in FIG. 2 by a bold line 19A, and to the strut portion 20, as depicted by a bold line 19B. That arrangement provides a better distribution of the forces transmitted by the first and second hydraulic cylinders 18 and 19 to the hull 11.

In operation, an operator uses operator controls 21 to control a motor and pump system 22 and valving 23 to control the flow of hydraulic fluid from a hydraulic fluid reservoir 24 to the first and second hydraulic cylinders 18 and 19. The motor and pump system 22 is operatively connected to the two hydraulic cylinders 18 and 19 via the valving 23 and it includes at least two hydraulic pumps (not individually shown) in order to provide hydraulic pump redundancy. Individual pumps are not shown for illustrative convenience, but they may take the form of known hydraulic components.

Hydraulic fluid pumped by the motor and pump system 22 to the first hydraulic cylinder 18 via the valving 23 and a first hydraulic line 25 causes the first hydraulic cylinder 18 to extend, while hydraulic fluid pumped by the motor and pump system 22 to the first hydraulic cylinder 18 via the valving 23 and a second hydraulic line 26 causes the first hydraulic cylinder 18 to retract. Similarly, hydraulic fluid pumped by the motor and pump system 22 to the second hydraulic cylinder 19 via the valving 23 and a third hydraulic line 27 causes the second hydraulic cylinder 19 to extend, while hydraulic fluid pumped by the motor and pump system 22 to the second hydraulic cylinder 19 via the valving 23 and a fourth hydraulic line 27 causes the second hydraulic cylinder 19 to retract. As they extend and retract under operator control that way, the first and second hydraulic cylinders 18 and 19 cause the strut portion 20 to pivot about a pivotal axis 20A in order to thereby move (or swing) the ballast-supporting structure 13 and the ballast 12 to a desired position relative to the hull 11. Based upon the foregoing and subsequent descriptions, one of ordinary skill in the art can readily implement a CBTF sailing yacht with an onboard ballast drive system according to the invention.

Figure 3:
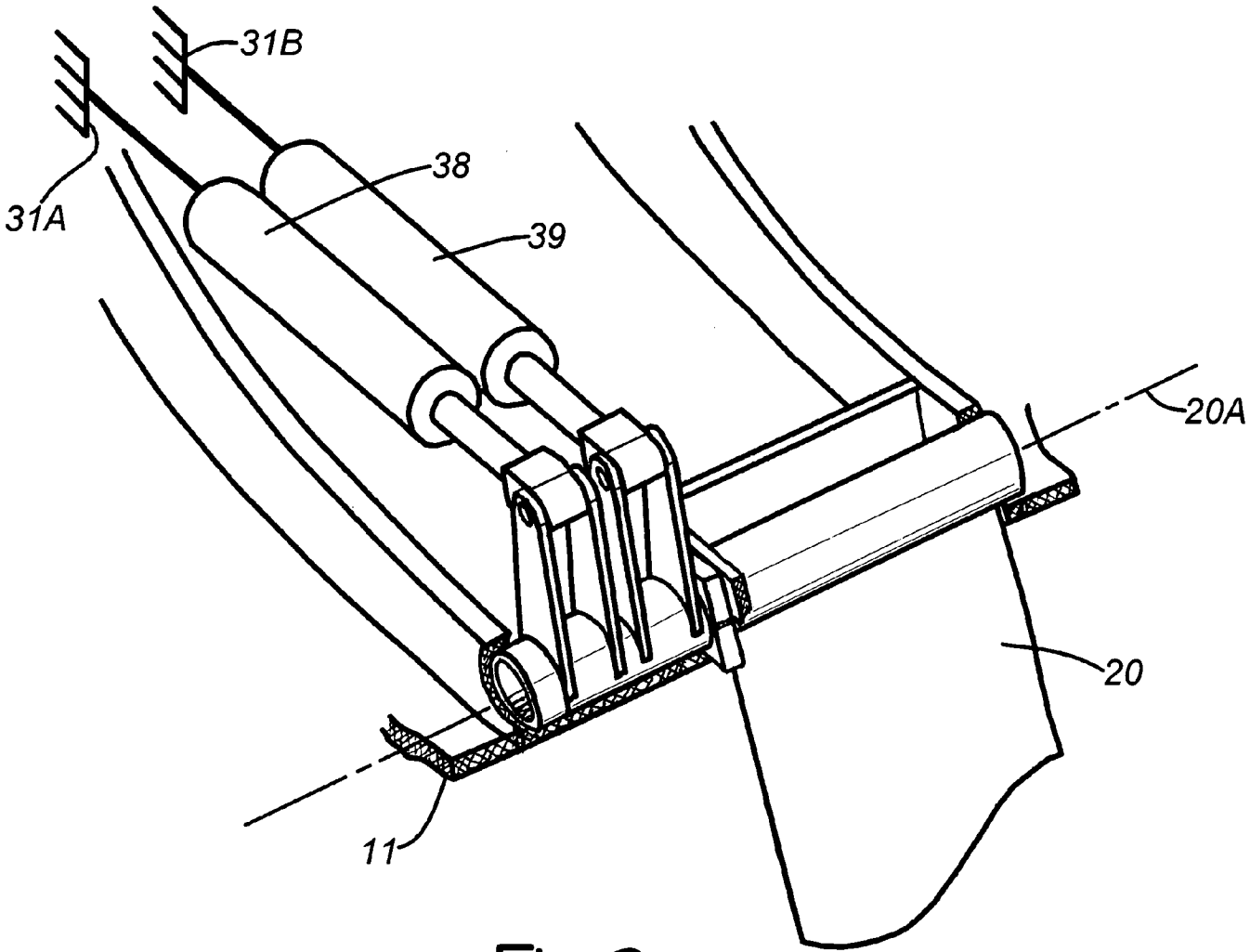
FIG. 3 is a perspective view of the strut portion of the ballast-supporting structure along with dual hydraulic cylinders arranged for parallel operation.

Turning now to FIG. 3, it shows first and second hydraulic cylinders 38 and 39 connected to the strut portion 20 and to first and second hull portions 31A and 31B as described for the first and second hydraulic cylinders 18 and 19 in FIG. 2.

They are also connected by hydraulic lines and to the valving 23, but those details are omitted for illustrative convenience. The first and second hydraulic cylinders 38 and 39 are arranged for parallel operation. They extend together and retract together. In the event one cylinder fails (including failure of hydraulic line coupling hydraulic fluid to it or the related pump and/or valving), the other cylinder assumes the full load. This redundancy helps avoid catastrophic failure underway.

Figure 4:
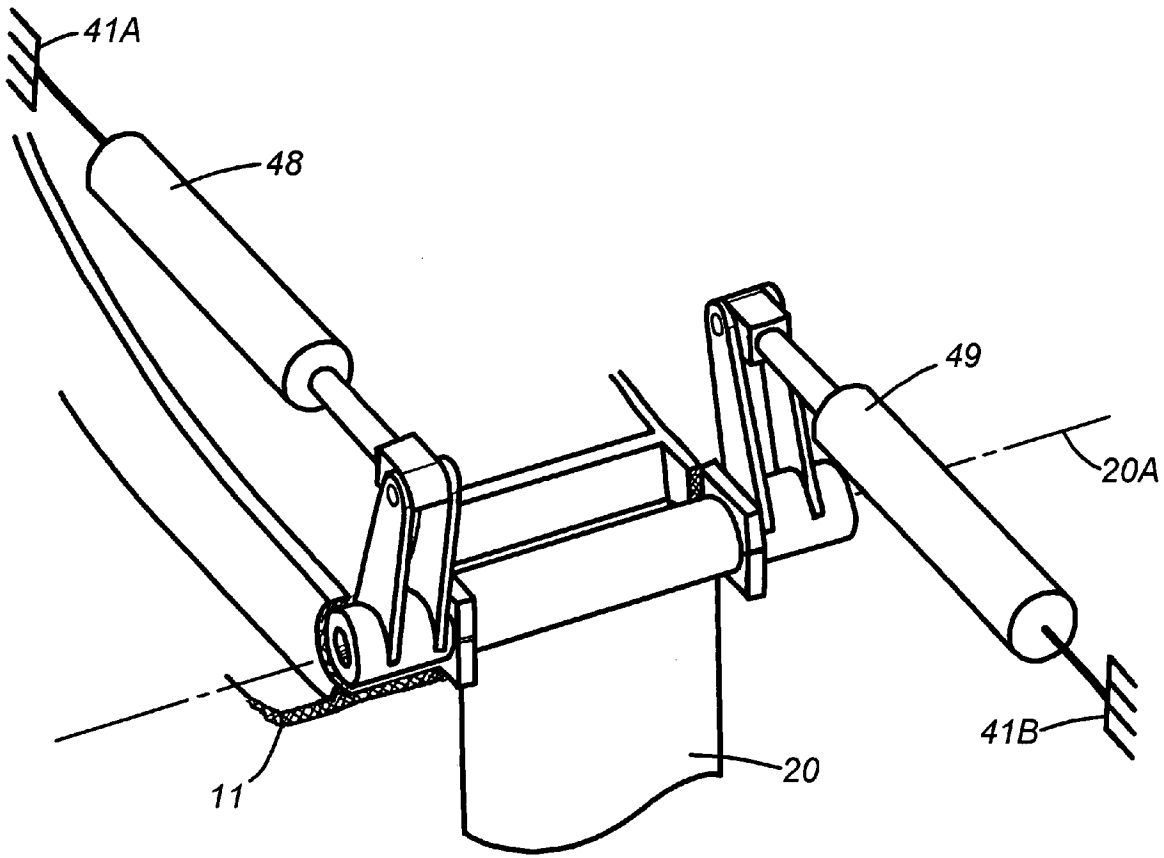
FIG. 4 is a perspective view of the strut portion with dual hydraulic cylinders arranged for push-pull operation.

FIG. 4 shows first and second hydraulic cylinders 48 and 49 connected to the strut portion 20 and to first and second hull portions 41A and 41B as described for the first and second hydraulic cylinders 18 and 19 in FIG. 2. They are also connected by hydraulic lines and to the valving 23, and those details are omitted for illustrative convenience. The first and second hydraulic cylinders 48 and 49 are arranged for push-pull operation. As the first one extends, the second one retracts. As the first one retracts, the second one extends.

Figure 5:
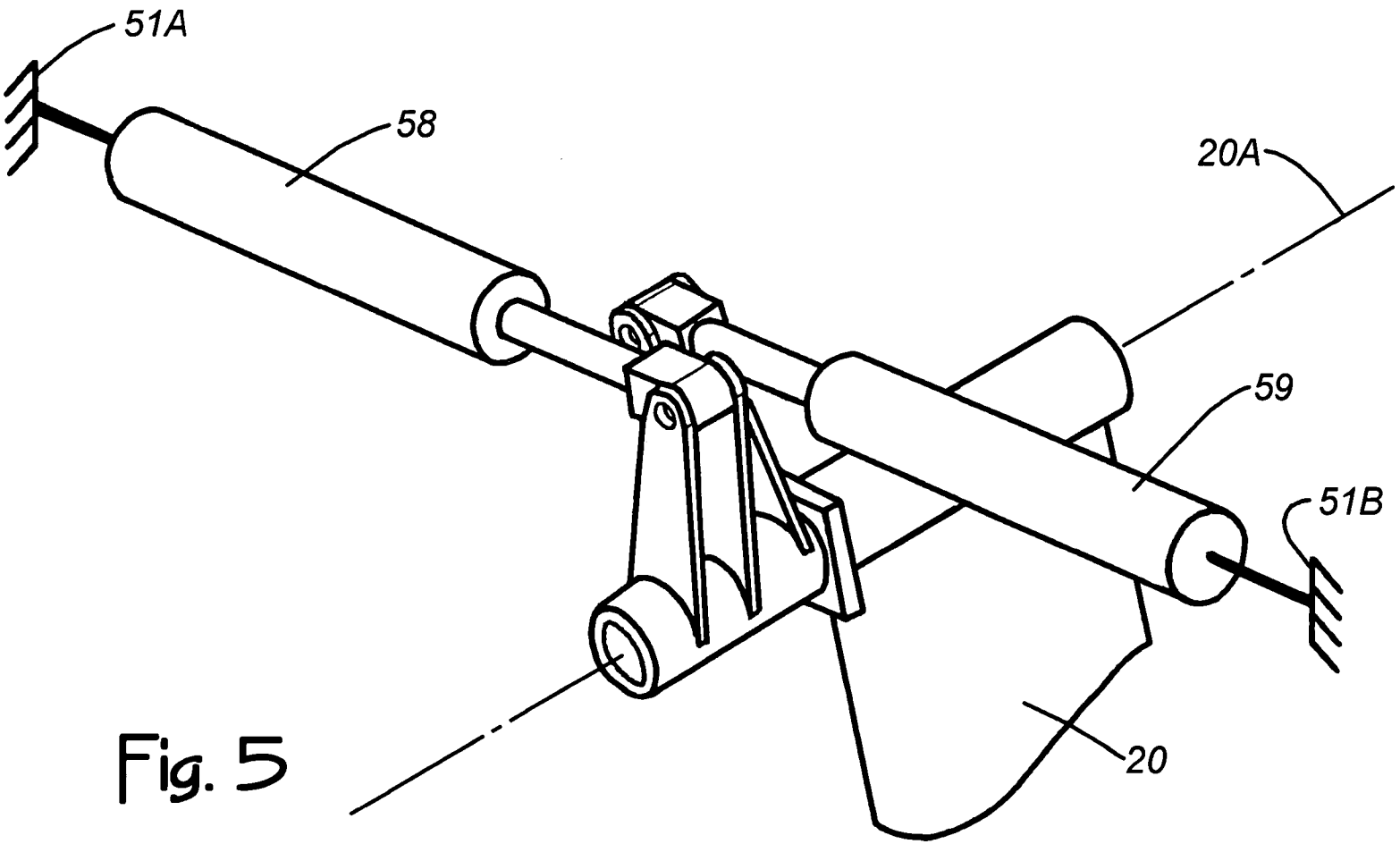
FIG. 5 is a perspective view of the strut portion with dual hydraulic cylinders arranged another way for push-pull operation.

FIG. 5 shows first and second hydraulic cylinders 58 and 59 connected to the strut portion 20 and to first and second hull portions 51A and 51B as described for the first and second hydraulic cylinders 18 and 19 in FIG. 2. They are also connected by hydraulic lines and to the valving 23, and those details are omitted for illustrative convenience. The first and second hydraulic cylinders 58 and 59 are also arranged for push-pull operation.

Figure 6:
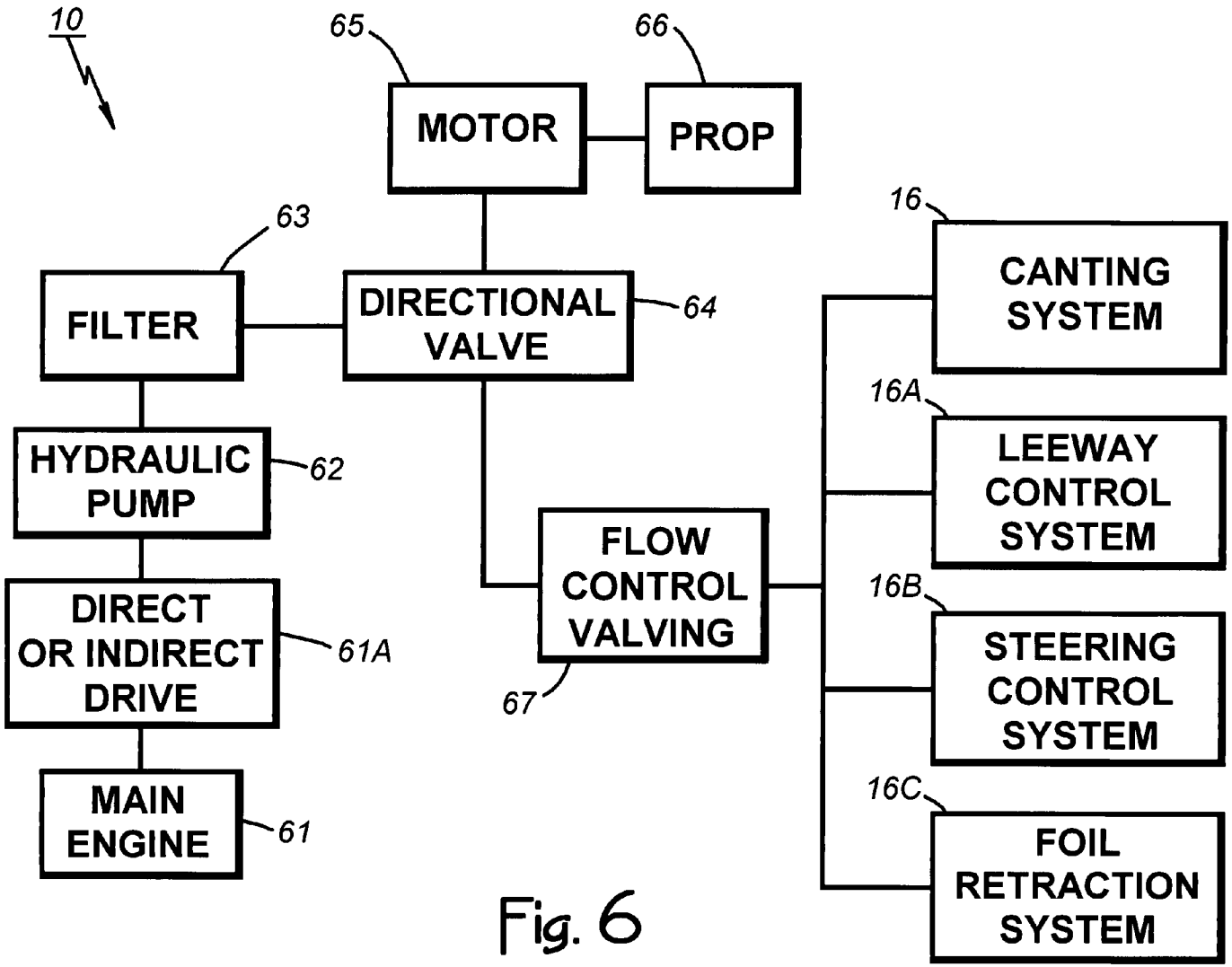
FIG. 6 is a block diagram of a main engine driven hydraulic source for the onboard ballast drive system.

Main Engine Drive System. According to another aspect of the invention, the sailing yacht 10 also includes a main engine ballast drive system 16 onboard the sailing hull 11 as depicted generally in FIG. 1 and in more detail in the block diagram form in FIG. 6. A main engine 61 onboard the sailing yacht 10 (e.g., a diesel or gasoline engine) drives a hydraulic motor pump 62 that pumps hydraulic fluid via a conventional in-line filter 63 to a directional valve 64 (FIG. 6). The hydraulic motor pump 62 is driven directly by suitable mechanical coupling to the main engine 61, or indirectly through a battery/electric system onboard the yacht 10 whereby the main engine 61 drives a charging device (not shown) that charges an onboard battery (not shown) that powers an electric form of the hydraulic motor pump 62. The block 61A in FIG. 6 is intended to represent either of those two alternatives. The directional valve 64 (e.g., manually or electrically operated) couples the hydraulic fluid to one or both of two hydraulic line branches that are operator selected by operation of the directional valve 64.

The first hydraulic line branch couples the hydraulic fluid from the directional valve 64 to a hydraulic motor 65 that drives a yacht-propelling propeller 66. The second hydraulic line branch couples the hydraulic fluid from the directional valve 64 to a flow control valving component 67 that couples the hydraulic fluid to the valving 23 of the onboard ballast drive system 16 discussed earlier, and/or to a leeway control system 16A and/or a steering control system 16B that are depicted in block diagram form in FIGS. 6, 7, and 8. As described earlier, the valving 23 controls the flow of the hydraulic fluid to the first and second hydraulic cylinders 18 and 19 in order to move the ballast 12 and thereby vary the counter-heeling force. The valving 23 also controls the flow of the hydraulic fluid to the leeway control system 16A for leeway control and to the steering control system 16B for steering control. Based upon the foregoing and subsequent descriptions, one of ordinary skill in the art can readily implement a main engine drive system according to the invention, with or without said system powering a yacht-propelling propeller.

Figure 7:
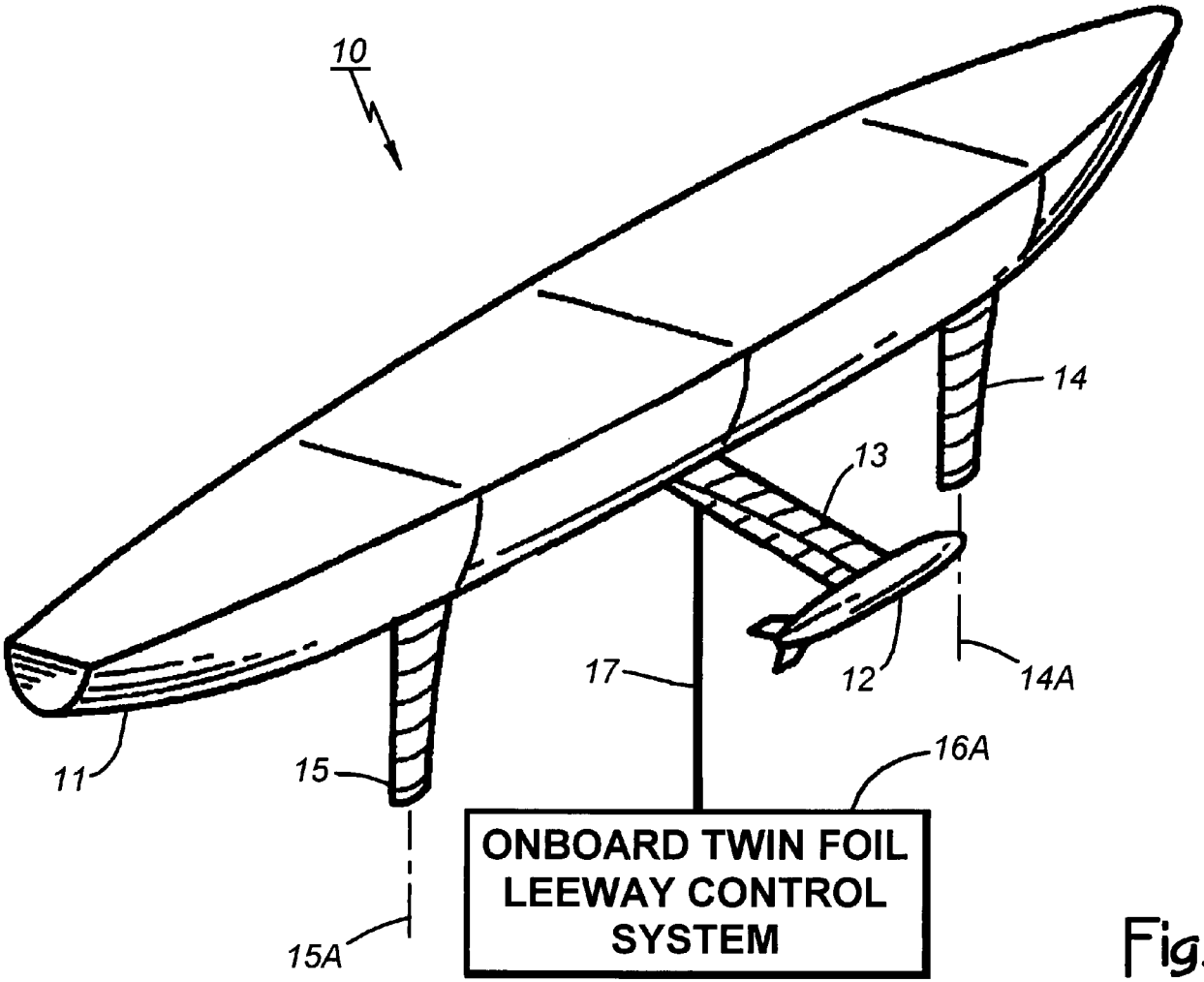
FIG. 7 is a diagrammatic representation similar to FIG. 1 of the CBTF sailing yacht that shows a twin foil onboard leeway control system.
Figure 8:
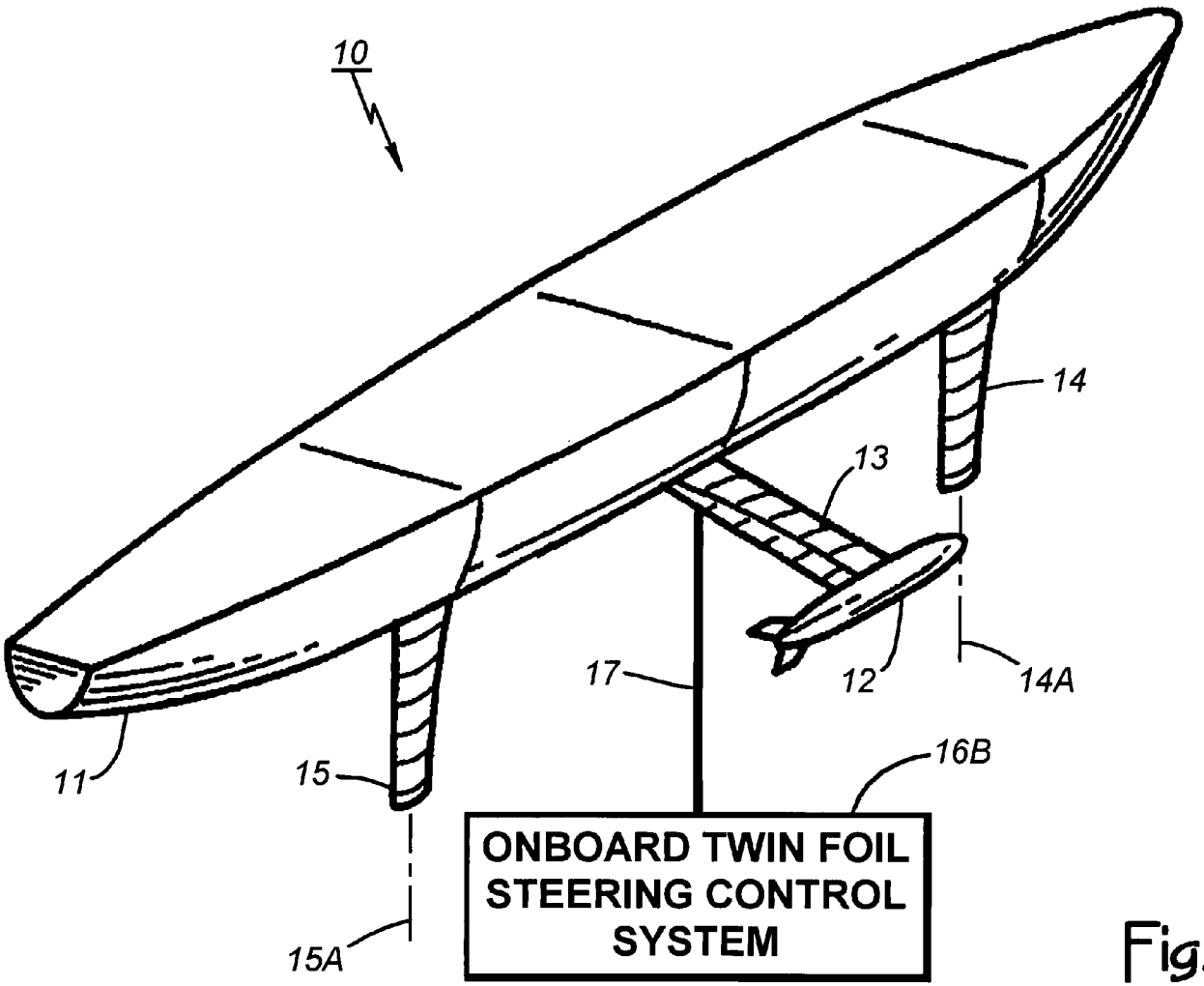
FIG. 8 is a diagrammatic representation similar to FIG. 1 of the CBTF sailing yacht that shows a twin foil steering system.

The fore and aft foils 14 and 15 depend downwardly from the hull 11, each being mounted on the hull 11 for rotation about (i.e., pivotal movement about) a respective one of a fore axis 14A that is disposed forward of the ballast 12 and the ballast-supporting structure 13 and an aft axis 15A disposed rearward of the ballast 12 and the ballast-supporting structure 13 (FIGS. 7 and 8). The fore and aft foils 14 and 15 depend downwardly and generally into bow and stern waves produced by the hull 11. They are so constructed that they is provide the principal resistance to leeway for the yacht 10. Preferably, a hull retraction system 16C (FIG. 6) is included for retracting at least one of the fore and aft foils 14 and 15 into the hull 11 while underway.

The leeway control system 16A includes means for rotating the fore and aft foils 14 and 15 together in the same direction (i.e., counterclockwise to port and clockwise to starboard). It includes a hydraulic system powered by the main engine drive either directly by suitable coupling or indirectly by a battery/electric system with battery recharging by the main engine drive as described above for the ballast drive system 16. The leeway control system 16A rotates the fore and aft foils 14 and 15 together by means of a suitable mechanical, hydraulic, or electrical linkage between the fore and aft foils 14 and 15, or by independent means, including, for example, hydraulic or electrical systems. FIG. 6 depicts a hydraulic leeway system 16A.

The steering control system 16B includes means for rotating the fore and aft foils 14 and 15 together in opposite ones of clockwise and counterclockwise directions for improved steering control. In other words, it rotates the fore foil 14 to port (counterclockwise about the fore axis 14A view from above) as it rotates the aft foil 15 to starboard, and it rotates the fore foil 14 to starboard (clockwise about the fore axis 14A view from above) as it rotates the aft foil 15 to port. It includes a hydraulic system powered by the main engine drive either directly by suitable coupling or indirectly by a battery/electric system with battery recharging by the main engine drive as described above for the ballast drive system 16. The steering control system 16B rotates the fore and aft foils 14 and 15 together by means of a suitable mechanical, hydraulic, or electrical linkage between the fore and aft foils 14 and 15, or by independent means including hydraulic or electrical systems. FIG. 6 depicts a hydraulic steering control system 16B.

Thus, the invention provides a sailing yacht that overcomes some significant disadvantages of prior art canting ballast systems while providing functionality that enhances sailing yacht operation. Although exemplary embodiments have been shown and described, one of ordinary skill in the art may make many changes, modifications, and substitutions without necessarily departing from the spirit and scope of the invention.

What is claimed is:

1. A sailing yacht, comprising:

a sailing hull;

a ballast;

a ballast-supporting structure that functions as means for supporting the ballast beneath the sailing hull moveably in order to produce a counter-heeling force that can be varied underway by movement of the ballast-supporting structure;

a ballast drive system onboard the sailing hull that functions as means for moving the ballast-supporting structure in order to vary the counter-heeling force;

a main engine drive system onboard the sailing hull that functions as means for powering the ballast drive system, said main engine drive system including a main engine onboard the sailing hull, a hydraulic pump driven by the main engine that pumps hydraulic fluid, and a flow control valve that couples the hydraulic fluid to the ballast drive system;

fore and aft foils such that the fore foil is mounted on the hull for rotation about a fore axis that extends below the hull in a position forward of the ballast and the aft foil is mounted on the hull for rotation about an aft axis that extends below the hull in a position rearward of the ballast, said fore and aft foils being mounted on the hull to extend downwardly from the hull; and first means for rotating the fore and aft foils together clockwise and together counterclockwise for leeway control;

wherein the first means is powered by the main engine drive system directly.

2. A sailing yacht as recited in claim 1, wherein the main engine drives the hydraulic pump directly.

3. A sailing yacht as recited in claim 1, wherein the main engine drives the hydraulic pump indirectly by recharging a battery/electric system onboard the sailing yacht.

4. A sailing yacht, comprising:

a sailing hull;

a ballast;

a ballast-supporting structure that functions as means for supporting the ballast beneath the sailing hull moveably in order to produce a counter-heeling force that can be varied underway by movement of the ballast-supporting structure;

a ballast drive system onboard the sailing hull that functions as means for moving the ballast-supporting structure in order to vary the counter-heeling force;

a main engine drive system onboard the sailing hull that functions as means for powering the ballast drive system, said main engine drive system including a main engine onboard the sailing hull, a hydraulic pump driven by the main engine that pumps hydraulic fluid, and a flow control valve that couples the hydraulic fluid to the ballast drive system;

fore and aft foils such that the fore foil is mounted on the hull for rotation about a fore axis that extends below the hull in a position forward of the ballast and the aft foil is mounted on the hull for rotation about an aft axis that extends below the hull in a position rearward of the ballast, said fore and aft foils being mounted on the hull to extend downwardly from the hull; and first means for rotating the fore and aft foils together clockwise and together counterclockwise for leeway control;

wherein the first means is powered by the main engine drive system indirectly.

5. A sailing yacht as recited in claim 4, wherein the main engine drives the hydraulic pump directly.

6. A sailing yacht as recited in claim 4, wherein the main engine drives the hydraulic pump indirectly by recharging a battery/electric system onboard the sailing yacht.

7. A sailing yacht, comprising:

a sailing hull;

a ballast;

a ballast-supporting structure that functions as means for supporting the ballast beneath the sailing hull moveably in order to produce a counter-heeling force that can be varied underway by movement of the ballast-supporting structure;

a ballast drive system onboard the sailing hull that functions as means for moving the ballast-supporting structure in order to vary the counter-heeling force;

a main engine drive system onboard the sailing hull that functions as means for powering the ballast drive system, said main engine drive system including a main engine onboard the sailing hull, a hydraulic pump driven by the main engine that pumps hydraulic fluid, and a flow control valve that couples the hydraulic fluid to the ballast drive system;

fore and aft foils such that the fore foil is mounted on the hull for rotation about a fore axis that extends below the hull in a position forward of the ballast and the aft foil is mounted on the hull for rotation about an aft axis that extends below the hull in a position rearward of the strut and ballast, said fore and aft foils being mounted on the hull to extend downwardly from the hull; and second means for rotating the fore and aft foils in opposite clockwise and counterclockwise for steering control;

wherein said second means is powered by the main engine drive system directly.

8. A sailing yacht as recited in claim 7, wherein the main engine drives the hydraulic pump directly.

9. A sailing yacht as recited in claim 7, wherein the main engine drives the hydraulic pump indirectly by recharging a battery/electric system onboard the sailing yacht.

10. A sailing yacht, comprising:

a sailing hull;

a ballast;

a ballast-supporting structure that functions as means for supporting the ballast beneath the sailing hull moveably in order to produce a counter-heeling force that can be varied underway by movement of the ballast-supporting structure;

a ballast drive system onboard the sailing hull that functions as means for moving the ballast-supporting structure in order to vary the counter-heeling force;

a main engine drive system onboard the sailing hull that functions as means for powering the ballast drive system, said main engine drive system including a main engine onboard the sailing hull, a hydraulic pump driven by the main engine that pumps hydraulic fluid, and a flow control valve that couples the hydraulic fluid to the ballast drive system;

fore and aft foils such that the fore foil is mounted on the hull for rotation about a fore axis that extends below the hull in a position forward of the ballast and the aft foil is mounted on the hull for rotation about an aft axis that extends below the hull in a position rearward of the strut and ballast, said fore and aft foils being mounted on the hull to extend downwardly from the hull; and second means for rotating the fore and aft foils in opposite clockwise and counterclockwise for steering control;

wherein said second means is powered by the main engine drive system indirectly.

11. A sailing yacht as recited in claim 10, wherein the main engine drives the hydraulic pump directly.

12. A sailing yacht as recited in claim 10, wherein the main engine drives the hydraulic pump indirectly by recharging a battery/electric system onboard the sailing yacht.

* * * * *